US005250200A

United States Patent [19]

Sallet

[11] Patent Number: 5,250,200

[45] Date of Patent: Oct. 5, 1993

[54] HYDROFLUOROALKANE FIRE/FLAME EXTINGUISHING COMPOUNDS

[75] Inventor: Daniel Sallet, Serquigny, France

[73] Assignee: Atochem, Puteaux, France

[21] Appl. No.: 712,720

[22] Filed: Jun. 10, 1991

[30] Foreign Application Priority Data

Jun. 8, 1990 [FR] France ..... 90 07154

[51] Int. Cl.[5] ..... A62D 1/08

[52] U.S. Cl. ..... 252/8; 252/2; 169/47

[58] Field of Search ..... 252/2, 3, 8

[56] References Cited

U.S. PATENT DOCUMENTS

| | | | |
|---|---|---|---|
| 1,926,396 | 9/1933 | Midgley et al. | 252/8 |
| 3,479,286 | 11/1969 | Gambaretto | 252/8 |
| 4,459,213 | 7/1984 | Uchida et al. | 252/8.05 |
| 4,810,403 | 3/1989 | Bivens et al. | 252/67 |
| 5,040,609 | 8/1991 | Dougherty, Jr. et al. | 169/45 |
| 5,064,559 | 11/1991 | Merchant et al. | 252/171 |
| 5,084,190 | 1/1992 | Fernandez | 252/8 |
| 5,113,947 | 5/1992 | Robin | 169/46 |
| 5,124,053 | 6/1992 | Iikubo et al. | 252/8 |
| 5,141,654 | 8/1992 | Fernandez | 252/8 |
| 5,196,137 | 3/1993 | Merchant | 252/172 |

*Primary Examiner*—Richard D. Lovering
*Assistant Examiner*—Joseph D. Anthony
*Attorney, Agent, or Firm*—Burns, Doane, Swecker & Mathis

[57] ABSTRACT

An environmentally safe fire fighting technique comprises directing a fire/flame extinguishing amount of an essentially zero ODP hydrofluoroalkane compound (other than a tetrafluoroethane or pentafluoroethane) onto a burning fire or flame, e.g., by total flooding.

3 Claims, No Drawings

HYDROFLUOROALKANE FIRE/FLAME EXTINGUISHING COMPOUNDS

CROSS-REFERENCE TO COMPANION APPLICATIONS

My copending applications Serial No. 07/712,741 and Ser. No. 07/712,739, both filed concurrently herewith and both assigned to the assignee hereof.

BACKGROUND OF THE INVENTION

1. Field of the Invention

The present invention relates to the use of hydrofluoroalkanes other than the tetrafluoroethanes and pentafluoroethane for fire and flame extinguishing applications.

2. Description of the Prior Art

It is known to this art that the chlorobromofluoroalkanes and bromofluoroalkanes are useful fire extinguishing agents.

In particular, bromotrifluoromethane, bromochlorodifluoromethane and 1,2-dibromo-1,1,2,2-tetrafluoroethane are useful such agents.

These compounds have high fire and flame extinguishing efficiency and very low toxicity to humans. They are especially useful for protecting premises from which the on-site personnel are only difficultly evacuated.

They are likewise useful for protecting premises where corrosion-sensitive electrical and electronic equipment is present (computer room, switchboards, etc.).

However, these compounds are suspected of being responsible for reducing the stratospheric ozone layer which provides protection against certain radiation. They have high ODPs (ozone depletion potentials) and are therefore cited in the Montreal Protocol.

This protocol is the result of recent international conferences on the environment and commits the signatory countries to reducing the production and consumption of compounds of this type.

SUMMARY OF THE INVENTION

Accordingly, a major object of the present invention is the provision of an improved fire fighting technique utilizing certain hydrofluoroalkane compounds which are far less damaging to the stratospheric ozone layer than the aforesaid prior art ecotoxic compounds, such hydrofluoroalkanes having the general formula:

$$C_nH_mF_x \quad (I)$$

in which n is an integer ranging from 1 to 6, m and x are integers at least equal to 1 and the sum (m+x) is equal to 2n or 2n+2, with the proviso that said hydrofluoroalkanes of formula (I) cannot be a tetrafluoroethane or pentafluoroethane.

DETAILED DESCRIPTION OF THE PREFERRED EMBODIMENTS OF THE INVENTION

More particularly according to the present invention, among the compounds of formula (I), those in which m is equal to 1 or 2 are the preferred.

Of the compounds of formula (I), 1,1,1,2,3,3,3-heptafluoropropane, 1,1,1,2,2,3,3,4,4-nonafluorobutane and 1,1,1,3,3,3-hexafluoropropane are more particularly preferred.

The fire extinguishing efficiency of the hydrofluoroalkanes of the invention is measured by the cup burner method.

This method indicates the minimum percentage of the extinguishing compound (measured by volume) in a mixture of air plus extinguishing compound necessary for extinguishing a liquid fuel that is on fire.

The lower the cup burner value, the more efficient the fire/flame extinguishing compound.

The compounds according to the invention have cup burner values which are low (in general less than 10%) and therefore have a high fire and flame extinguishing capacity.

By way of example, bromotrifluoromethane, which is presently one of the most widely used fire extinguishing agents, has a cup burner value equal to 4.2%, but, as aforesaid, is cited in the Montreal Protocol.

The compounds according to the invention present the advantage of exhibiting ODPs of zero. This indicates that they are devoid of any destructive effect with respect to the stratospheric ozone layer.

The ODP is defined as the ratio between the lowering of the ozone column recorded on emission of one unit weight of agent and the same lowering for trichlorofluoromethane selected as a reference (ODP=1). For example, bromotrifluoromethane has an ODP of 10.

The compounds according to the invention have little corrosive action and have low toxicity for humans.

They can be used for fire fighting utilizing the same techniques as used with bromotrifluoromethane and bromochlorodifluoromethane.

Thus, they can advantageously be used for the protection of premises by the so-called total flooding technique.

They can also be pressurized with inert gases, such as nitrogen or tetrafluoromethane, which permits their rate of discharge to be increased.

Likewise, they can be employed in portable extinguishing/extinction techniques/apparatus.

In order to further illustrate the present invention and the advantages thereof, the following specific examples are given, it being understood that same are intended only as illustrative and in nowise limitative.

EXAMPLES 1 and 2

Measurement of the fire/flame extinguishing efficiency of the compounds according to the invention:

The fire/flame extinguishing efficiency was measured by the cup burner method described in the draft Standard ISO/DIS 7075-1.

The liquid fuel used was ethanol.

The results obtained are reported in the following Table:

TABLE

| EXAMPLE | COMPOUND | CUP BURNER (%) |
|---|---|---|
| 1 | $CF_3CFHCF_3$ | 8.5 |
| 2 | $CF_3(CF_2)_2CF_2H$ | 9 |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A fire fighting technique comprising directing a fire/flame extinguishing amount of a hydrofluoroalkane compound onto a burning fire or flame, said hydrofluoroalkane compound having the formula:

$$C_nH_mF_x \quad \text{(I)}$$

in which n is an integer ranging from 4 to 6, m and x are integers wherein m is 1 or 2, and the sum $(m+x)$ is equal to $2n$ or $2n+2$.

2. The fire fighting technique as defined by claim 1, wherein said hydrofluoroalkane compound is 1,1,1,2,2,3,3,4,4-nonafluorobutane.

3. The fire fighting technique as defined by claim 1, said hydrofluoroalkane compound being pressurized with an inert gas.

* * * * *